US008596187B2

(12) United States Patent
Nommensen et al.

(10) Patent No.: US 8,596,187 B2
(45) Date of Patent: Dec. 3, 2013

(54) METHOD OF CALIBRATING A CONNECTING ROD ARRANGEMENT AND CONNECTING ROD ARRANGEMENT

(75) Inventors: Marten Nommensen, Flensburg (DE); Heinz-Otto Lassen, Flensburg (DE)

(73) Assignee: Secop GmbH, Flensburg (DE)

( * ) Notice: Subject to any disclaimer, the term of this patent is extended or adjusted under 35 U.S.C. 154(b) by 952 days.

(21) Appl. No.: 12/691,233

(22) Filed: Jan. 21, 2010

(65) Prior Publication Data

US 2010/0236401 A1 Sep. 23, 2010

(30) Foreign Application Priority Data

Jan. 23, 2009 (DE) ..... 10 2009 005 935

(51) Int. Cl.
*F01B 9/00* (2006.01)
*B21D 53/84* (2006.01)
*F16C 7/00* (2006.01)

(52) U.S. Cl.
USPC ..... 92/140; 29/888.09; 74/579 E

(58) Field of Classification Search
USPC ..... 92/140; 29/888.09, 888.092; 123/197.3, 123/197.4; 74/579 E
See application file for complete search history.

(56) References Cited

U.S. PATENT DOCUMENTS

| | | | | |
|---|---|---|---|---|
| 1,368,194 | A * | 2/1921 | Patmon | 72/31.03 |
| 3,262,335 | A * | 7/1966 | Heinlein et al. | 74/581 |
| 3,598,665 | A | 8/1971 | Seulen et al. | |
| 4,250,372 | A | 2/1981 | Tani | |
| 5,719,374 | A | 2/1998 | Frackiewicz et al. | |
| 6,929,019 | B2 | 8/2005 | Weinmann et al. | |
| 7,416,621 | B2 | 8/2008 | Knott | |

FOREIGN PATENT DOCUMENTS

| | | |
|---|---|---|
| DE | 671433 | 2/1939 |
| DE | 888401 | 8/1953 |
| DE | 1552854 | 8/1969 |
| DE | 3830028 C1 | 12/1989 |
| DE | 10 2006 028 617 | 2/2008 |
| DE | 112006001926 T5 | 7/2008 |
| EP | 0904886 A1 | 3/1999 |
| EP | 1285705 A2 | 2/2003 |
| EP | 1358963 A1 | 11/2003 |
| EP | 1457720 A1 | 9/2004 |

* cited by examiner

*Primary Examiner* — Michael Leslie
(74) *Attorney, Agent, or Firm* — McCormick, Paulding & Huber LLP

(57) ABSTRACT

The invention relates to a method of calibrating a connecting rod arrangement comprising a crankshaft eye and a connecting rod eye. In order to achieve the best possible parallelism between the connecting rod eye and the crankshaft eye a controlled energy input occurs in at least one predefined surface area of the connecting rod, so that outside a neutral axis a local structural change and thus a tension in the connecting rod occurs.

12 Claims, 5 Drawing Sheets

METHOD OF CALIBRATING A CONNECTING ROD ARRANGEMENT AND CONNECTING ROD ARRANGEMENT

CROSS REFERENCE TO RELATED APPLICATION

Applicant hereby claims foreign priority benefits under U.S.C. §119 from German Patent Application No. 10 2009 005 935.0 filed on Jan. 23, 2009, the contents of which are incorporated by reference herein.

FIELD OF THE INVENTION

The invention relates to a method of calibrating a connecting rod arrangement comprising a crank eye and a connecting rod eye. Further, the invention concerns such a connecting rod arrangement.

BACKGROUND OF THE INVENTION

In the following, the invention will be described on the basis of a refrigerant compressor, for example as used in domestic refrigerators and freezers. Such a compressor should work in a substantially maintenance-free manner and still have a good efficiency.

This requires the lowest possible friction between the mechanical components of the compressor. In this connection, the friction is not only influenced by the relative movement of the sliding and rotating components, but also by jamming effects occurring from the sum of shape and position deviations.

A sufficient tightness when the piston moves in the cylinder, for example, requires a very accurate adaptation of the piston to the cylinder. Further, the piston must move as exactly as possible along the axis of the cylinder. As soon as an angle error occurs, the piston moves in the cylinder in an unbalanced manner, so that increased friction and increased wear occur. Finally, leakages may occur in the compressor, which will further reduce the efficiency.

A substantial reason for the occurrence of such angle errors is the lack of parallelism between the two connecting rod eyes of the connecting rod. With the manufacturing methods used until now, it has not been possible to obtain an axis parallelism of 2 μm or less in relation to a length of 20 mm. Previously, a relatively expensive subsequent mechanical treatment would be required to obtain a higher accuracy. However, this subsequent mechanical treatment will change the tribologic properties of the connecting rod arrangement, in particular the wear resistance.

DE 10 2006 028 617 B3 discloses a connecting rod arrangement that has a rotating joint between the crank eye and the connecting rod eye. This rotating joint permits a slewing movement of the crank eye in relation to the connecting rod eye, so that angle errors are equalised. However, the manufacturing of such a connecting rod arrangement is relatively expensive. The additional bearing causes the connecting rod arrangement to have a relatively large weight, which is disadvantageous with regard to heavy vibrations. The bearing may also permit a play between the connecting rod eye and the crank eye, which further deteriorates the efficiency.

SUMMARY OF THE INVENTION

The invention is based on the task of providing a method of calibrating a connecting rod arrangement and a connecting rod arrangement, so that the disadvantages described above are avoided.

According to the invention, this task is solved by a method as mentioned in the introduction in that in at least one predefined surface area of the connecting rod a controlled energy input occurs.

In this connection, the energy input advantageously occurs in a central area of the connecting rod. The energy input causes a relatively strong heating of a restricted surface area in the connecting rod. The subsequent cooling imposes a tension on the connecting rod that causes a concave bending of the connecting rod. This influences the parallelism of the connecting rod eye in relation to the crankshaft eye. Repeated energy inputs, which can also occur in adjacent surface areas, the desired bending and thus the parallelism of the connecting rod eye and the crankshaft eye can be adjusted very accurately. A mechanical working of the connecting rod arrangement is not required.

Preferably, a piston is connected to the connecting rod arrangement before the calibration is performed. The assembled connecting rod arrangement and piston can still be handled in an appropriate manner. Thus, the angle between the piston and the crankshaft eye can be very accurately established, which ensures a particularly low-friction operation. A longitudinal axis of the piston should possible extend at an angle of 90° in relation to a symmetry axis of the crankshaft eye.

It is particularly preferred that the energy input occurs by at least one punctual irradiation, in particular with a laser. Thus, firstly the area exposed to the energy input can be very accurately defined. Secondly, the size of the energy input can be very well controlled. Also a multi-stage calibration, during which a measuring is performed after each energy input, is thus possible.

Preferably, the energy input causes a melting of the surface area. The melting and subsequent hardening cause relatively high tensions in the connecting rod. Thus, the angle position between the crankshaft eye and the connecting rod eye is efficiently influenced.

Preferably, a parallelism of symmetry axes of the crankshaft eye and the connecting rod eye is determined, and the energy input is repeated until an angle deviation between the symmetry axes is smaller than a threshold value. Such a threshold value can be definitely predetermined and, for example, amount to 20 μm or 15 μm over 70 mm. The repeated measurings, each followed by an energy input, permit a very accurate calibration. This process can also take place automatically. For example, the use of this method is also possible in an assembly line.

In a preferred embodiment, the method is used on a connecting rod arrangement that is connected to a crankshaft and a piston, in particular such, which are fitted in a compressor. In this connection a calibration is not necessarily made with regard to the highest possible parallelism between the crankshaft eye and the connecting rod eye, but with regard to a substantially jam-free movement of a crankshaft in relation to a piston. When the calibration is performed on a connecting rod arrangement that is connected to a crankshaft and a piston, but not yet fitted in the compressor, a simplified handling occurs. Thus, the correct angle position of the crankshaft and the piston can be set very accurately.

The task is solved by a connecting rod arrangement as mentioned in the introduction in that outside a neutral axis the connecting rod comprises at least one local structural change.

The neutral axis of a rod is the area that is exposed to neither compressive strain nor tension during a bending. With a symmetric component, this neutral axis is located in the centre. Due to the local structural changes outside the neutral axis, that is, particularly in the surface area, the connecting rod is exposed to a tension that causes a bending torque on the connecting rod. The parallelism between the crankshaft eye and the connecting rod eye can thus be very accurately set.

It is particularly preferred that the structural change forms at least one plasticised area. The term "plasticised area" covers an area that has melted because of an energy input, for example with a laser, and subsequently hardened again. This method can give rise to relatively high tensions, which cause the desired bending of the connecting rod.

Preferably, the local structural change is located in a central area between the crankshaft eye and the connecting rod eye. Thus, the structural change is effected approximately at the same distance from the crankshaft eye and the connecting rod eye. This means that a relatively symmetric deformation of the connecting rod arrangement is achieved.

Preferably, the symmetry axes of the crankshaft eye and the connecting rod eye have an angle deviation in relation to one another of less than 20 μm, in particular less than 15 μm over 70 mm. This means that the parallelism between the crank shaft eye and the connecting rod eye is very high. This small angle deviation permits a use of the connecting rod arrangement with practically no angle errors, so that only little friction and thus little wear must be expected.

Advantageously, a refrigerant compressor is provided with such a connecting rod arrangement. Thus, a piston of the refrigerant compressor can be guided inside a cylinder of the refrigerant compressor with a very small gap. If expedient, a calibration of the connecting rod arrangement can take place after mounting in a refrigerant compressor. The generation of the structural changes permit a very accurate adaptation of the connecting rod arrangement to the conditions in the refrigerant compressor. The life and the efficiency of the refrigerant compressor are thus increased.

BRIEF DESCRIPTION OF THE DRAWINGS

In the following, the invention is described on the basis of a preferred embodiment in connection with the drawings, showing.

DETAILED DESCRIPTION OF THE PREFERRED EMBODIMENTS

Figure 1:
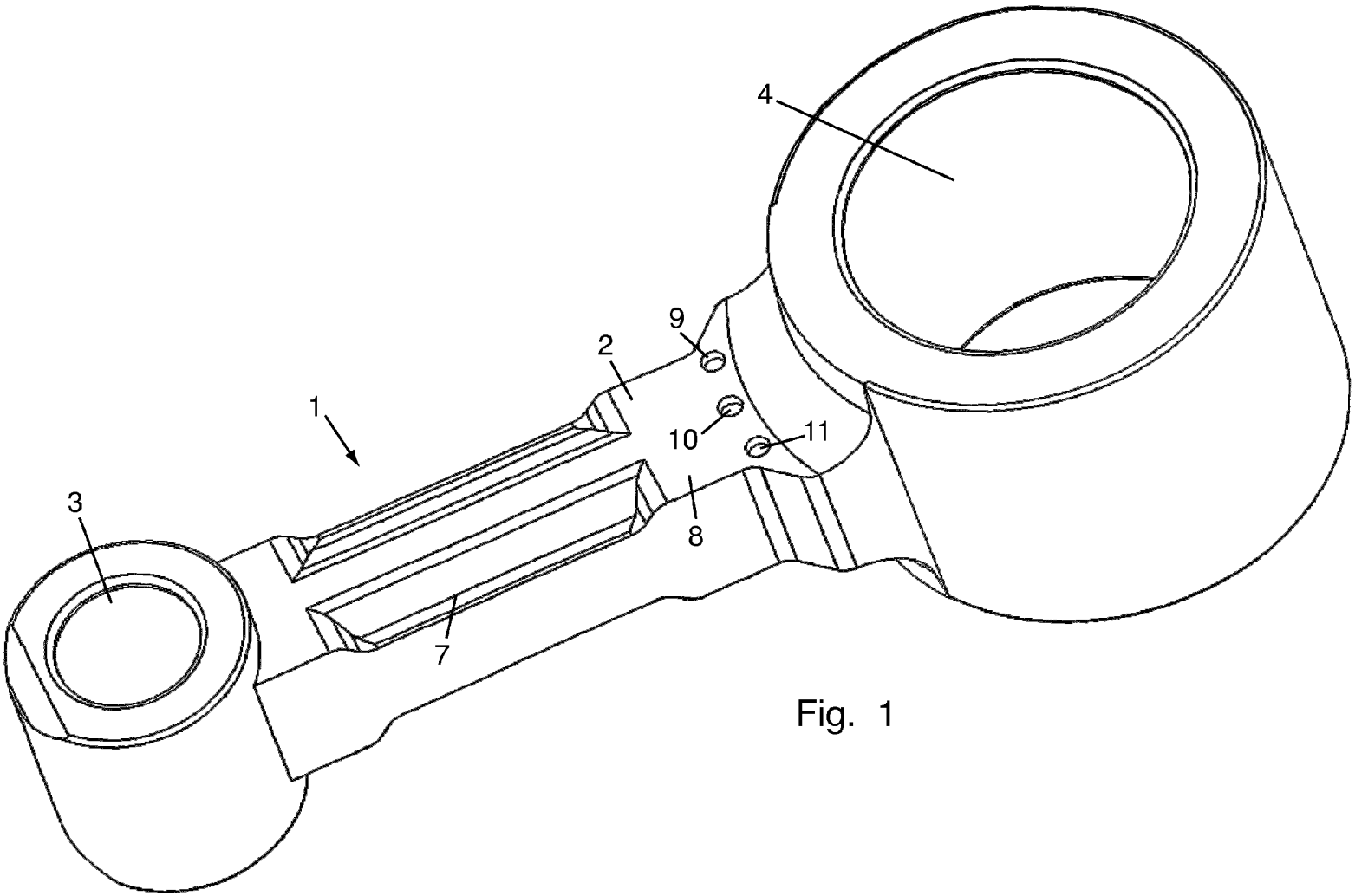
FIG. 1 is a schematic view of a connecting rod arrangement.

FIG. 1 shows a connecting rod arrangement 1 with a connecting rod 2. At one end of the connecting rod 2 is arranged a connecting rod eye 3, at the other end of the connecting rod 2 is arranged a crankshaft eye 4. The connecting rod eye 3 serves the purpose of connecting the connecting rod arrangement to a piston 12 of a refrigerant compressor 6, as shown in the FIGS. 3 and 4.

The connecting rod 2 comprises recesses 7 with the purpose of reducing the mass of the connecting rod 2. Three local structural changes 9, 10, 11 are located on a surface 8 of the connecting rod 2.

In this embodiment, the structural changes 9, 10, 11 are not arranged in the exact centre, but somewhat closer to the crankshaft eye 4. It can also be imagined to provide more or less than three structural changes 9, 10, 11. The number of the structural changes and also the size of the areas, in which the structural changes occur, depend on the size of the desired deformation. If expedient, an energy input can also take place in neighbouring surfaces.

The structural changes 9, 10, 11 are only arranged in the area of the surface 8 of the connecting rod 2. Therefore, the structural changes 9, 10, 11 are provided outside a neutral axis of the connecting rod.

The structural changes 9, 10, 11 are generated by punctual irradiation by means of a laser. The energy input causes a melting of the area of the connecting rod, in which a punctual irradiation occurred. The melting and the subsequent hardening produce a tension in the connecting rod that causes a concave deformation. In FIG. 1, the structural changes 9, 10, 11 have a circular shape. However, the structural changes can also have other shapes.

Figure 2:
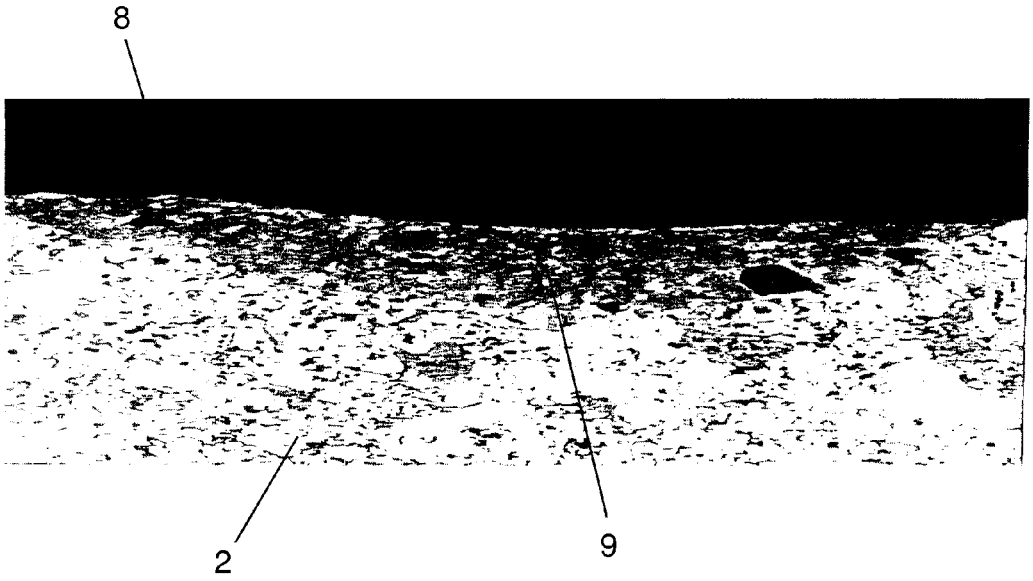
FIG. 2 shows a local structural change of a connecting rod.

FIG. 2 shows a cross-section through the connecting rod 2, the structural change 9 in the area of the surface 8 of the connecting rod 2 being visible. The connecting rod 2 is, for example, made of sintered iron or steel. However, the connecting rod arrangement 1 can also be made of other metallic materials.

Preferably, the connecting rod arrangement is made of an unalloyed sintered iron having an iron structure with $Fe_3O_4$. The hardness should be 100 kp/mm$^2$ or more. The density after the steam treatment should be 6.8 g/cm$^3$ or more. The material is not supposed to comprise any visible dirt and should reflect as little as possible.

Figure 3:
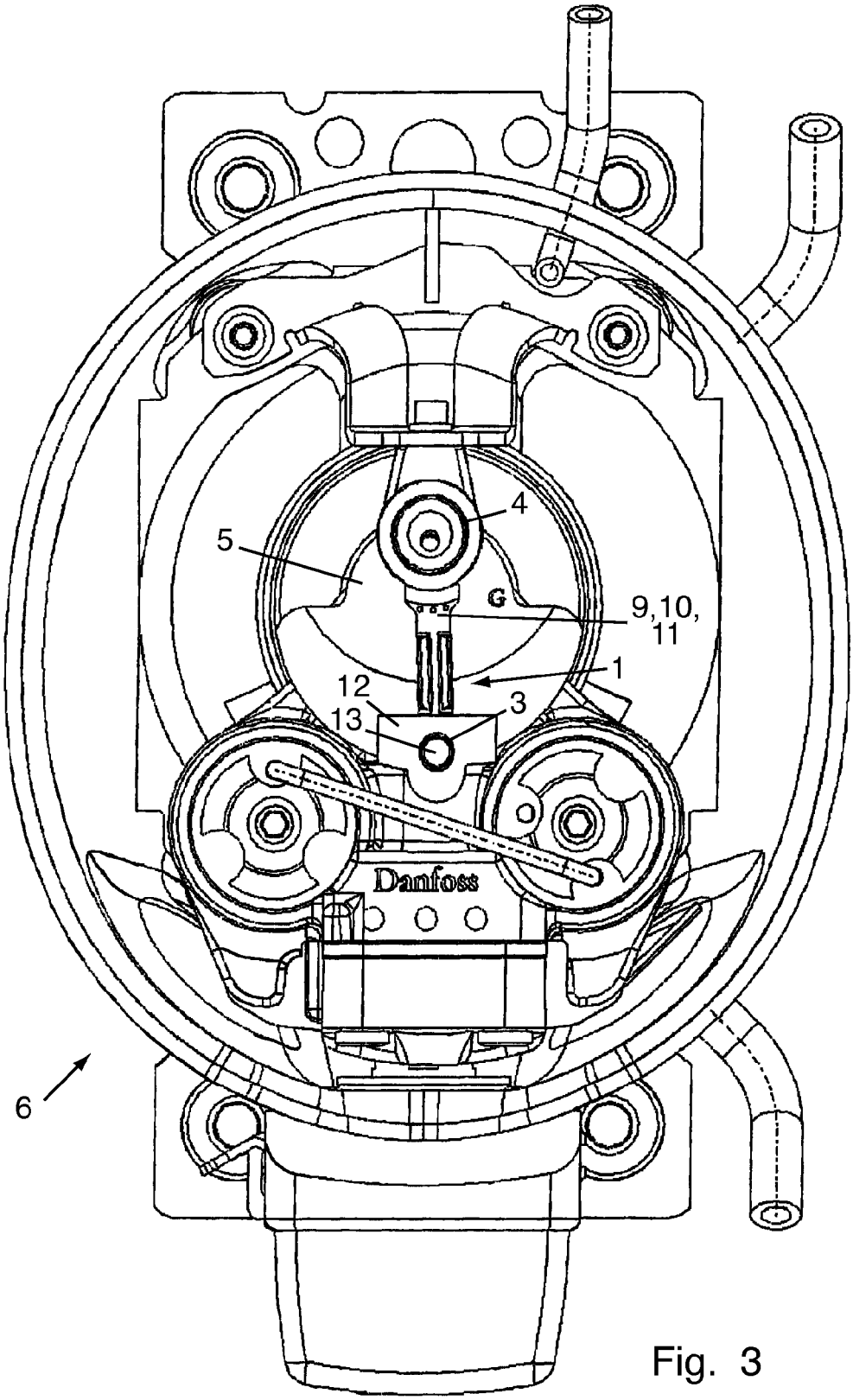
FIG. 3 shows a refrigerant compressor with a connecting rod arrangement.

FIG. 3 shows a top view of a refrigerant compressor 6, in which the connecting rod arrangement 1 connects a crankshaft 5 to a piston 12. The piston 12 is connected to the connecting rod arrangement 1 by means of a pivot 13.

Figure 4:
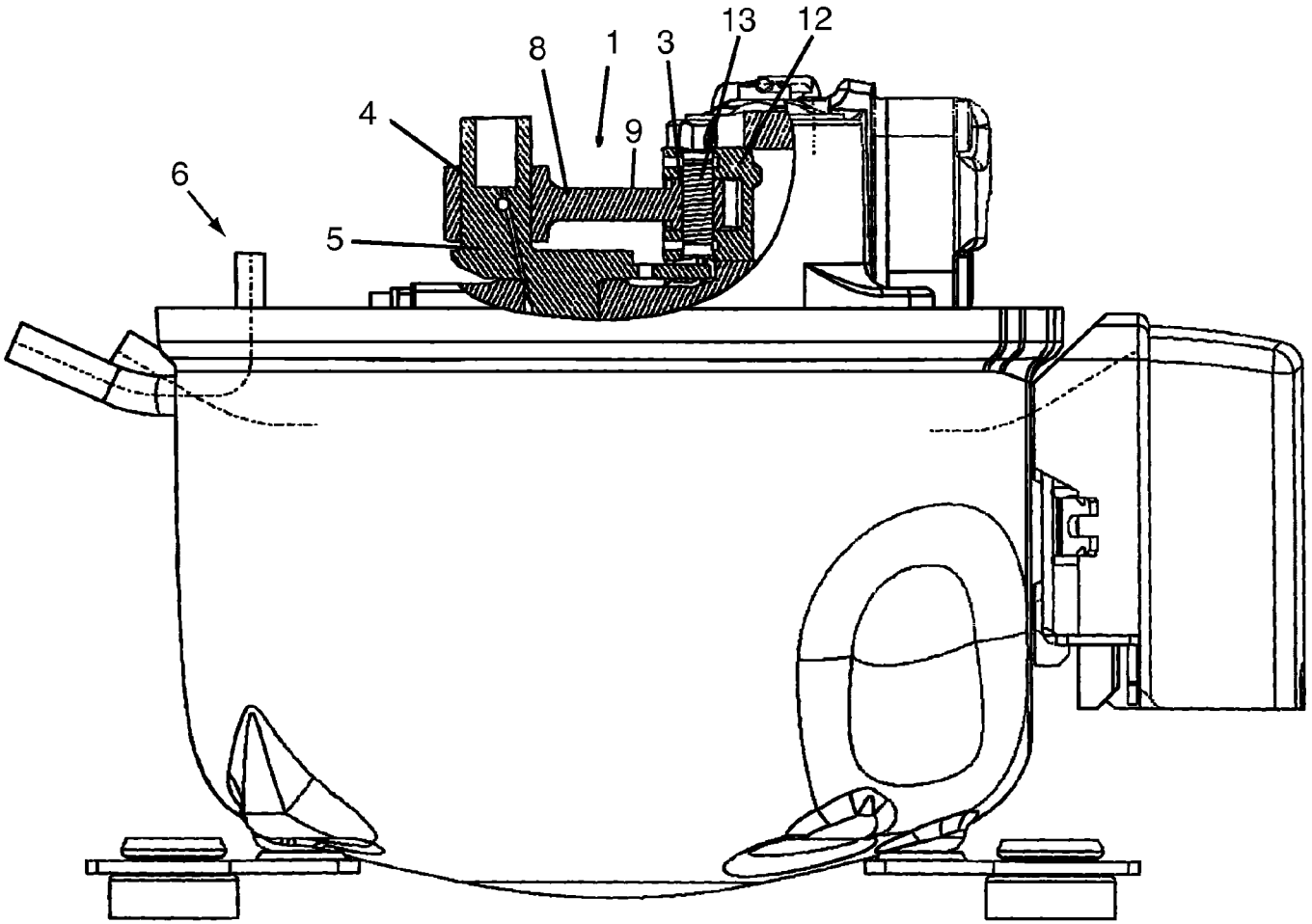
FIG. 4 shows a refrigerant compressor with a connecting rod arrangement in a partly sectional view.

FIG. 4 shows a cross-section of the connecting rod arrangement that is fitted inside the refrigerant compressor 6. In relation to their symmetry axes, the connecting rod eye 3 and the crankshaft eye 4 have an angle deviation of less than 20 μm over 70 mm. The crankshaft 5 and the piston 12, which are connected to one another via the connecting rod arrangement 1, can therefore be moved in a very low-frictional manner.

Figure 5:
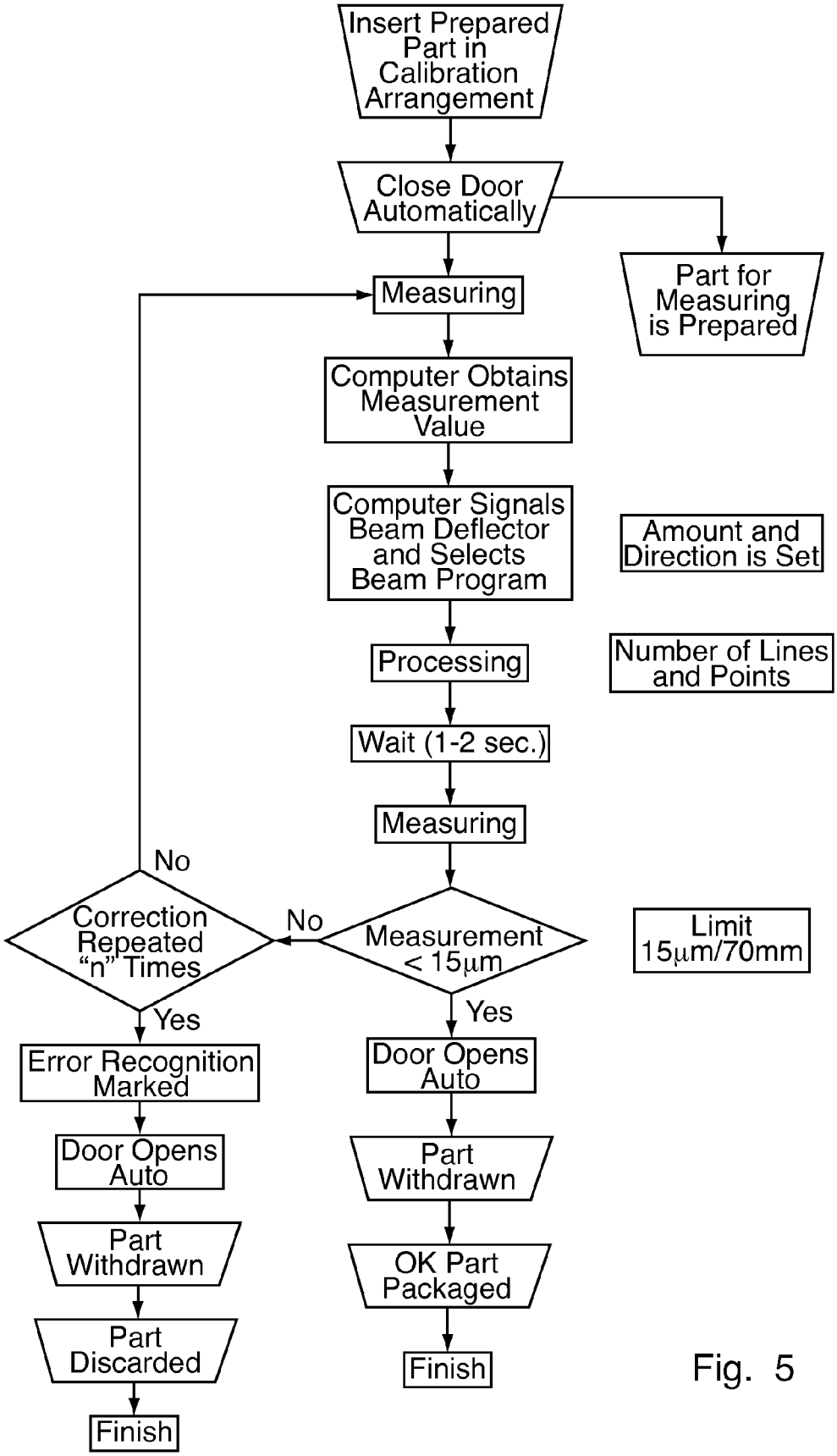
FIG. 5 is a flow chart for a method of calibrating a connecting rod arrangement.

FIG. 5 shows a possible flow chart of the method according to the invention. Firstly, the connecting rod arrangement is inserted in a calibration arrangement. Then, the parallelism between the connecting rod eye and the crankshaft eye is measured, and a computer is used to determine the strength and the site for at least one laser energy input in the surface of the connecting rod arrangement 1 occurs. Thus, a surface area of the connecting rod arrangement 1 is melted. Subsequently, the connecting rod arrangement is cooled, so that the structural change caused by the melting hardens again. Inside the connecting rod arrangement the local structural changes remain, which are located outside a neutral axis. These structural changes generate a tension in the connecting rod arrangement that causes a concave deformation of the connecting rod. After the cooling, the parallelism of connecting rod eye and crankshaft eye is measured. If the parallelism corresponds to a desired measuring value, for example less than 20 μm or 15 μm over 70 mm, the connecting rod arrangement is taken out. If the desired parallelism has not been achieved, an additional irradiation is made.

It is also imaginable not the introduce the controlled input into the connecting rod arrangement, for example by means of a laser, until the connecting rod has already been assembled with a crankshaft and a piston or even has been mounted in the refrigerant compressor. In this case, the adaptation of the connecting rod arrangement does not in the first line concern the highest possible parallelism between the connecting rod eye and the crankshaft eye, but that the force transmission between the crankshaft and the piston causes as little friction as possible. The calibration of the connecting rod arrangement can also be made in an assembly line, in which the compressor is manufactured.

On a whole, the invention makes it possible to improve the efficiency of a refrigerant compressor and at the same time reduce the friction and increase the life. This makes the manufacturing of the connecting rod arrangement very accurate and relatively favourable.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method of calibrating a connecting rod arrangement having a crankshaft eye and a connecting rod eye comprising:

controlling energy input in at least one predefined surface area of the connecting rod;

wherein the energy input causes a melting of the surface area.

2. The method according to claim 1, further comprising connecting a piston to the connecting rod arrangement before the calibration is performed.

3. The method according to claim 1, further comprising:

determining a parallelism of symmetry axes of the crankshaft eye and the connecting rod eye, and repeating the energy input until an angle deviation between the symmetry axes is smaller than a threshold value.

4. The method according to claim 1, wherein, the energy input is made on a connecting rod arrangement that is connected to a crankshaft and a piston.

5. The method according to claim 4, wherein the crankshaft and the piston are fitted in a compressor.

6. A method of calibrating a connecting rod arrangement having a crankshaft eye and a connecting rod eye comprising:

controlling energy input in at least one predefined surface area of the connecting rod;

wherein the energy input occurs by at least one punctual irradiation.

7. The method according to claim 6 wherein the energy input occurs with a laser.

8. A connecting rod arrangement for a compressor, with a connecting rod comprising a crankshaft eye and a connecting rod eye, wherein outside a neutral axis the connecting rod comprises at least one local structural change; and wherein the structural change forms at least one plasticized area.

9. The connecting rod arrangement according to claim 8, wherein the local structural change is located in a central area between the crankshaft eye and the connecting rod eye.

10. The connecting rod arrangement according to claim 8, wherein the symmetry axes of the crankshaft eye and the connecting rod eye have an angle deviation in relation to one another of less than 20 μm over 70 mm.

11. A refrigerant compressor provided with a connecting rod arrangement according to claim 8.

12. The connecting rod arrangement according to claim 8, wherein the compressor is a refrigerant compressor.

* * * * *